US005666778A

United States Patent [19]

Grattan et al.

[11] Patent Number: 5,666,778

[45] Date of Patent: Sep. 16, 1997

[54] SYSTEM FOR CONSTRUCTING A BUILDING

[76] Inventors: Donald J. Grattan; Shannon Rose Grattan, both of 4828 N. Seeley, Chicago, Ill. 60625

[21] Appl. No.: 493,273

[22] Filed: Jun. 21, 1995

[51] Int. Cl.[6] ..... E04C 2/04

[52] U.S. Cl. ..... 52/606; 52/92.2; 52/233; 52/592.6; 52/605

[58] Field of Search ..... 52/233, 605, 606, 52/607, 592.6, 271, 98, 92.1, 92.2, 521, 543, 550

[56] References Cited

U.S. PATENT DOCUMENTS

| | | | |
|---|---|---|---|
| 426,535 | 4/1890 | Turczan | 52/233 |
| 4,172,344 | 10/1979 | Childress, Jr. et al. | 52/98 |
| 4,903,447 | 2/1990 | McDade | 52/233 |
| 5,020,289 | 6/1991 | Wrightman | 52/233 |

FOREIGN PATENT DOCUMENTS

| | | | |
|---|---|---|---|
| 617935 | 4/1961 | Canada | 52/233 |
| 405025868 | 2/1993 | Japan | 52/233 |
| 41970 | 10/1925 | Norway | 52/233 |
| 2040337 | 8/1980 | United Kingdom | 52/233 |

*Primary Examiner*—Carl D. Friedman
*Assistant Examiner*—Yvonne Horton-Richardson
*Attorney, Agent, or Firm*—Fitch, Even, Tabin & Flannery

[57] ABSTRACT

A system for constructing a building is disclosed which employs various side wall, corner and roof forming elements adapted to be joined in interlocked sealed relation without need for nails or skilled craftsman. The various elements may be made from relatively inexpensive materials, such as reclaimed materials indigenous to the site of construction, generally lighter than conventional building materials such as brick and mortar, and are therefore particularly suitable for use in countries of relatively low economic wealth. Furring clips may be formed on the internal surfaces of the wall and corner forming elements to facilitate attachment of interior wallboards and the like, while the external surfaces of the various elements may be textured to simulate a desired exterior appearance.

18 Claims, 2 Drawing Sheets

10
12
14
16
18
20
20'
22
22'
24
28
76
80
82
90
92
102
116
118
3

28
30
32
34
36
48a
48b
50a
50b

SYSTEM FOR CONSTRUCTING A BUILDING

FIELD OF THE INVENTION

The present invention relates generally to building structures, and more particularly to a novel system for constructing buildings which employs various wall and roof forming structural elements adapted to be assembled in interfitting sealed relation without nails or conventional construction tools by untrained personnel at on-site locations.

BACKGROUND OF THE INVENTION

The need for structurally sound and economical building structures, particularly in economically disadvantaged areas, is well known. Numerous building designs and construction techniques have been developed in an attempt to provide relatively low cost building structures which fulfill this need. One example is found in the concept of prefabricated buildings wherein substantial sections of a building are preconstructed at a central manufacturing facility and shipped to the construction site for final assembly. While such prefabricated building structures have in part met the need for more economical building structures, skilled craftsmen are required at the building site to complete assembly and finishing of the building. Another drawback of known prefabricated buildings is that, like conventional building techniques, relatively expensive building materials, such as wood, metal, and frequently external brick facings are employed which add greatly to the final construction costs.

SUMMARY OF THE INVENTION

The present invention overcomes the disadvantages in the prior art concepts of providing economical and structurally sound building structures, and particularly those suitable for housing, through the provision of a system for constructing a building employing structural elements which may be readily assembled in a safe and economical manner without need for special tools or skilled technicians. In accordance with the present invention, relatively simple construction techniques are employed which may be readily carried out by persons in economically disadvantaged areas. A major advantage of the system for constructing buildings in accordance with the present invention lies in its adaptability to low cost building materials such as man-made reclaimed materials or natural materials indigenous to certain areas in which the structures will be erected.

In accordance with the system and construction techniques of the present invention, substantially any basic building design may be accomplished employing substantially identical components or elements assembled in varying combinations. The system of the present invention lends itself particularly to the construction of buildings such as military barracks and emergency medical buildings and the like which may be quickly erected in disaster areas and which may subsequently be disassembled and transported to other areas for subsequent emergency use while maintaining their structural integrity.

Accordingly, one of the primary objects of the present invention is to provide a system for constructing buildings which employs structural elements which are economical to manufacture and which may be readily and safely assembled by unskilled persons to provide shelter or storage buildings, or more sophisticated buildings for housing.

Another object of the present invention is to provide a system for constructing buildings and the like employing novel wall forming and corner forming elements which may be color coded and assembled in interlocked and sealed stacked relation to provide a substantially weather-tight wall structure without the use of nails, and further employing novel roof joists and roof boards which also facilitate assembly without the use of nails.

A feature of the structural elements in accordance with the present invention lies in the provision of openings formed in the various wall and corner forming elements along the longitudinal lengths thereof, the openings being adapted for alignment with openings in underlying structural elements when in stacked relation therewith to facilitate insertion of retaining pegs into the aligned openings for preventing relative longitudinal shifting of the stacked elements, the pegs being readily inserted by a mallet, or in one embodiment, through a threaded connection facilitating removal of the pegs.

Another feature of the present invention lies in the provision of furring clips on the interior surfaces of the wall and corner forming elements which facilitate attachment of an interior surface such as sheetrock, the exterior exposed surfaces of the wall and corner elements optionally having a design such as simulated brick or the like formed thereon.

BRIEF DESCRIPTION OF THE DRAWINGS

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

DETAILED DESCRIPTION OF THE PREFERRED EMBODIMENTS

Figure 1:
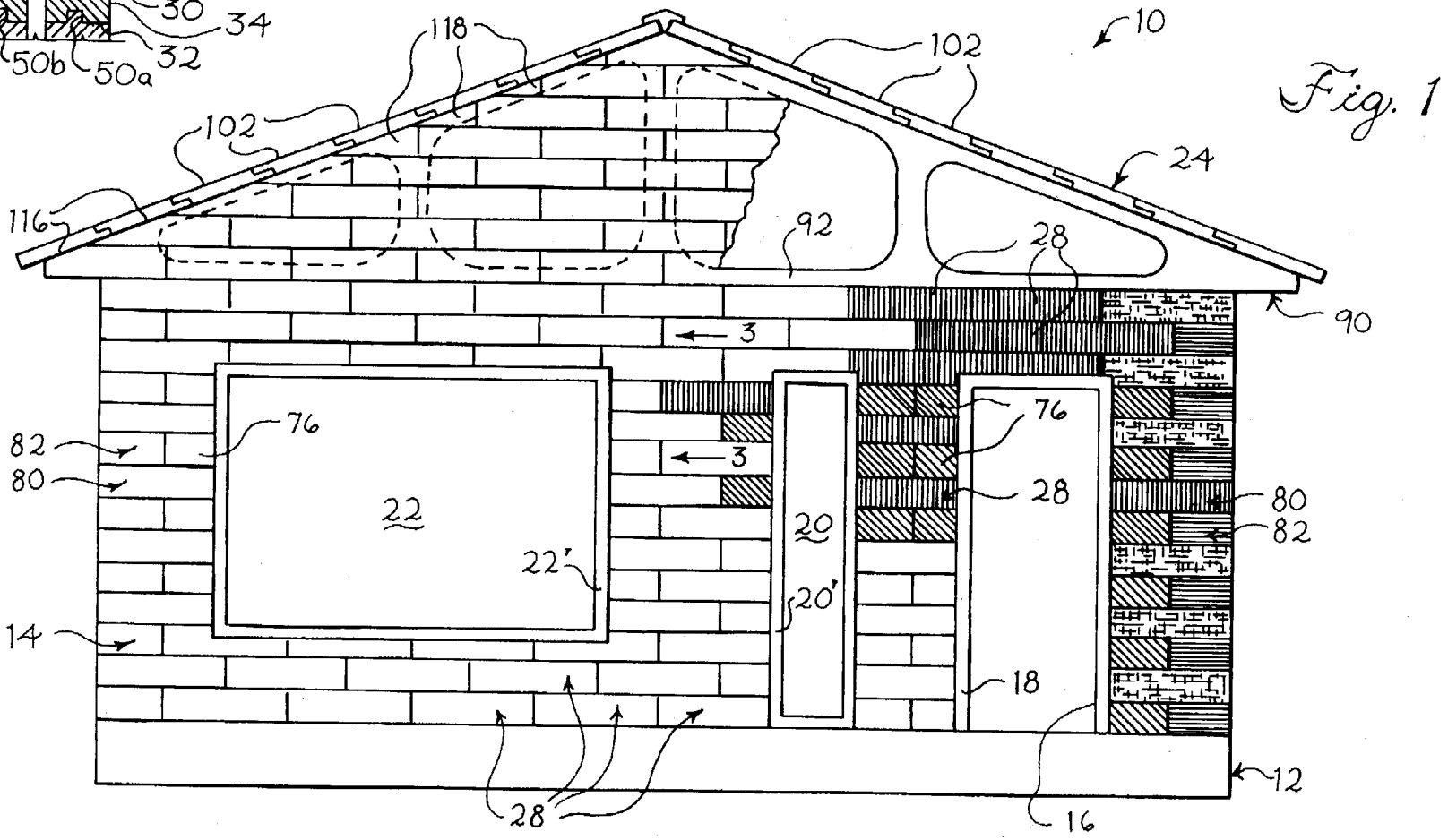
FIG. 1 is a front elevational view of a building constructed in accordance with the present invention.

Referring now to the drawings, a building constructed in accordance with the present invention is indicated generally at 10 in FIG. 1. The building 10 is illustrated, for purposes of example only, as comprising a building structure suitable for housing, such as a single family home. As will become more apparent with the following description of the building 10, the various components or elements from which the building is constructed lend themselves to easy assembly to provide a building having substantial structural integrity while facilitating low cost construction. The various elements may be made from reclaimed materials or other low cost materials such as found indigenous to the construction site. The various structural elements of the building 10 may be readily assembled without the need for skilled craftsmen and without nails or construction tools such as saws and the like as generally employed in conventional building construction techniques.

The building 10 is illustrated as having a foundation, indicated generally at 12, which may be made of concrete or any other suitable material and which provides sufficient foundation strength for supporting the building. FIG. 1 illustrates a front wall 14 of the building 10 which typifies the construction of the upstanding walls of the building. The building 10 has rearwardly extending side walls (not shown) and a rear wall (not shown) which are connected at corners to define a rectangular building having a roof 24 supported by the upstanding walls.

The front wall 14 has a door opening 16 defined by a conventional size door jamb 18 to which may be hingedly mounted a door (not shown) in a conventional manner. The front wall 14 also has a pair of windows 20 and 22 therein having respective window frames 20' and 22'.

Referring to FIG. 1, taken in conjunction with FIGS. 2–12, for a detailed description of the various structural elements employed in constructing the building 10, the front wall 14 includes a plurality of equal length unitary wall forming elements 28 which are termed "full" or "primary" wall forming elements. Each wall forming element 28 has upper and lower parallel stacking surfaces 30 and 32, respectively, inner and outer planar side wall surfaces 34 and 36, respectively, normal to the stacking surfaces 30 and 32, and end wall surfaces 38 and 40 disposed normal to the longitudinal axis of the full wall forming element 28. The wall forming elements 28 are rectangular in transverse cross section and each has a plurality of equal size cylindrical open holes 42 formed therethrough in spaced relation along its longitudinal axis so as to intersect the upper and lower stacking surfaces 30 and 32 in normal relation thereto. It is seen that a semi-cylindrical recess 44 having a radius equal to the radii of the openings 42 is formed in each end surface 38 and 40 in longitudinal alignment with the openings 42 for a purpose to be described more fully below.

In the described embodiment, the full wall forming elements 28 are made of a predetermined length, such as 32 inches, which, it will be observed, is twice the conventional spacing distance of 16 inches between centers of vertical studs as employed in wall constructions in the United States building trades. The full wall forming elements 28 have vertical thicknesses of approximately 1½ inches between the stacking surfaces 30 and 32, and transverse widths of approximately 5 inches, it being understood that substantially any desired dimensional sizes may be employed. The holes 42 have diameters of approximately ⅞ inch.

Figure 3:
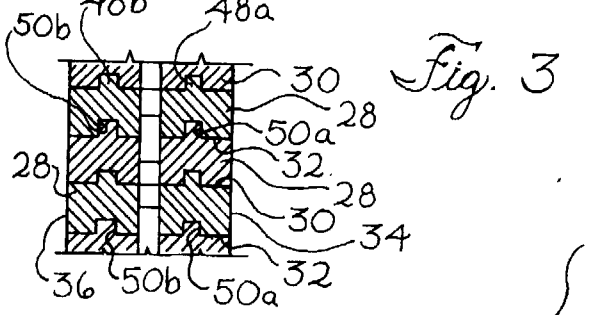
FIG. 3 is an enlarged fragmentary transverse sectional view, taken substantially along the line 3—3 of FIG. 1, illustrating a plurality of wall forming elements secured in stacked interlocked relation.
Figure 2:
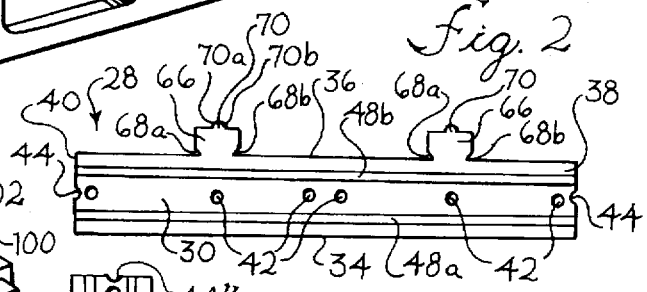
FIG. 2 is a plan view of a full wall forming element employed in making the walls of the building structure of FIG. 1.

The upper and lower stacking surfaces 30 and 32 of the full wall forming elements 28 are provided, respectively, with male and female interlocking means adapted to facilitate interlocking and sealing engagement between the wall forming elements when disposed in stacked relation. As best seen in FIGS. 2 and 3, each of the wall forming elements 28 has a pair of parallel longitudinally extending ribs or locking keys **48*a* and 48*b* formed on the surface 30 to directly overlie a pair of correspondingly shaped longitudinally extending slots or grooves 50*a* and 50*b* formed in the lower stacking surface 32. The ribs 48*a*, *b* on each wall forming element 28 are adapted for interfitting and interlocking engagement with the grooves 50*a*, *b*** in an adjacent wall forming element when a plurality of the full wall forming elements are stacked one on the other. The interfitting ribs and slots of the wall forming elements prevent relative shifting of the stacked elements transverse to their longitudinal axes, and provide a weather-tight seal between the stacked elements.

The openings 42 are positioned so that when a full wall forming element 28 is positioned in stacked overlying relation to two similar full wall forming elements such that the upper wall forming element overlies approximately one-half of each underlying wall forming element, the openings 42 of the stacked wall forming elements will be in vertical axial alignment. In such stacked and staggered relation, each wall forming element 28 is positioned in longitudinal end-to-end relation with another wall forming element such that the semi-circular recesses 44 of the two abutting end surfaces cooperate to define an opening having a diameter equal to the diameter of the openings 42. It is noted from FIG. 2 that six full openings 42 are provided in the full wall forming element 28, three openings being formed in each half of the wall forming element symmetrical about the transverse centerline.

An important feature of the present invention lies in the manner of securing the full wall forming elements to each other and to other wall and corner forming elements in staggered or offset relation without the use of nails. To this end, the building system in accordance with the present invention employs a plurality of cylindrical retaining pegs, one of which is indicated at 54 in FIG. 10. The retaining pegs 54 have diameters approximately equal to the diameter of the openings 42 so as to facilitate insertion of retaining pegs through the aligned openings 42 in the stacked wall forming elements and frictional retention therein. The pegs 54 have longitudinal lengths equal to approximately twice the vertical thickness of the wall forming elements 28 so that each peg is received within two axially aligned openings 42 in frictional engagement therewith. The pegs 54 prevent relative longitudinal movement between the stacked wall forming elements 28 as well as providing increased resistance to separation of the wall forming elements when subjected to a force generally transverse to the longitudinal axes thereof.

Figure 11:
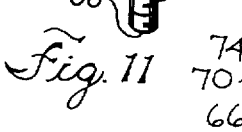
FIG. 11 illustrates an alternative retainer peg facilitating threaded releasable connection of the various elements.

FIG. 11 illustrates an alternative embodiment of a retaining peg, indicated at 58, which is substantially similar to the retaining peg 54 except that peg 58 has an external thread 60 formed thereon and includes a transverse screw driver slot 62 formed in one end to facilitate releasable threaded engagement of the retaining peg 58 within axially aligned openings 42 in stacked wall forming elements 28. Each of the retaining pegs 54 and 58 preferably has a rounded end thereon to facilitate entry into the openings 42, while the opposite ends of the pegs are flat to facilitate insertion by use of a mallet, the peg 58 also being rotatable by a screw driver.

As best seen in FIG. 2, the full wall forming element 28 has a pair of longitudinally spaced furring clips 66 formed integral therewith projecting outwardly from the inner side surface 34. Each furring clip 66 has a vertical height or thickness substantially equal to the vertical thickness of the associated wall forming element 28, and is formed with a plane of weakness defined between vertical grooves 68*a*, 68*b* to allow breaking off the furring clips, if desired, by impacting them with a mallet. In the illustrated embodiment, the furring clips 66 are spaced apart approximately 16 inches with each clip being spaced approximately 8 inches from the corresponding end of the wall forming element. Each furring clip 66 has an outwardly projecting vertically disposed rib 70 formed centrally thereon to facilitate positioning and retention of sheetrock or other interior sheeting in the finished building, a portion of sheetrock being shown at 74 in FIG. 12. The oppositely facing surfaces 70*a* and 70*b* on each rib 70 may be roughened or serrated to frictionally engage an edge of the sheetrock and retain it in upstanding assembled relation against vertically aligned furring clips 66 when the associated elements 28 are in stacked relation.

Figure 4:
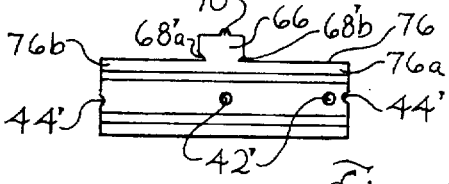
FIG. 4 is a plan view of a half wall forming element employed in making the walls of the building structure of FIG. 1.

It will be appreciated that when the full wall forming elements 28 are stacked in staggered relation as aforedescribed so that the stacking surfaces 30 and 32 of each element engage equal half length portions of the next adjacent underlying and overlying full wall forming elements, the free ends of all the stacked wall forming elements will not terminate in a common vertical plane such as at the edge of a window or door opening. Accordingly, shorter length wall forming elements 76, termed "half" or "secondary" wall forming elements, are provided for assembly with the wall forming elements 28 to establish substantially vertical planar edge surfaces defining desired wall openings such as for windows and doors. Each half wall forming element 76 is substantially identical to one-half a full wall forming element 28, as best seen in FIG. 4, and has a plurality of open holes 42' formed therethrough along its longitudinal axis. Each half wall forming element 76 has opposite end surfaces 76*a* and 76*b* in which are formed semi-cylindrical recesses 44' so that when a half wall element is assembled in stacked relation with one-half a full wall forming element 28, the openings 42' and recesses 44' are in vertical alignment with corresponding holes 42 and end recesses 44 in the full wall forming elements. A single furring clip 66' is provided centrally on each half wall forming element so as to be vertically aligned with furring clips on the underlying and overlying full wall forming elements.

As seen in FIG. 1, by employing the half wall forming elements 76 appropriately interposed in stacked relation with the full length wall forming elements 28, planar vertical edge surfaces are established at the desired locations for the door opening 16 and the windows 20 and 22. With the full wall forming elements 28 being approximately 32 inches in length, the half wall forming elements 76 are made 16 inches in length.

Figure 5:
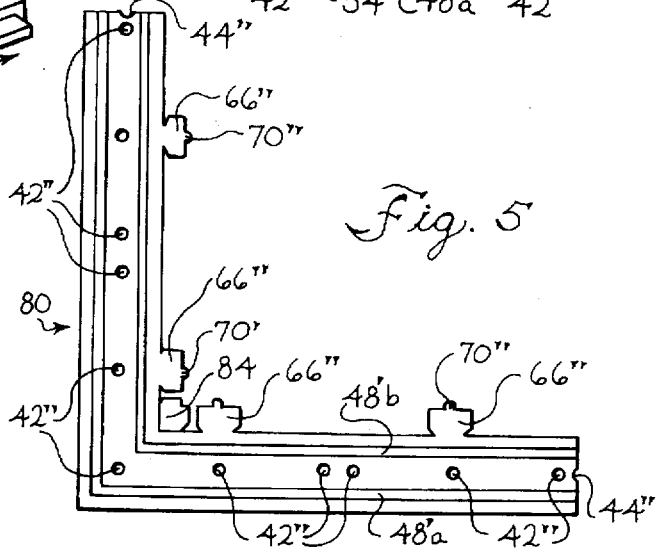
FIG. 5 is a plan view of a full corner forming element employed in making the corners of the building structure of FIG. 1.
Figure 6:
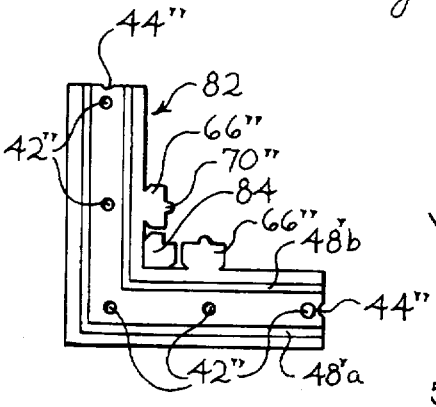
FIG. 6 is a half corner forming element employed in making the corners of the building structure of FIG. 1.
Figure 10:
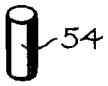
FIG. 10 illustrates, on an enlarged scale, one embodiment of a retainer peg for use in retaining the various elements in assembled relation.

FIGS. 5 and 6 illustrate, respectively, "full" and "half" corner forming elements 80 and 82 for the building structure 10. The corner forming elements 80 and 82 are identical in transverse cross sectional configuration to the wall forming elements 28 and 76 and each includes a pair of upstanding parallel longitudinal ribs or locking keys 48'*a*, 48'*b* formed on an upper stacking surface 84, and similarly configured parallel longitudinally extending slots 50*a* and 50*b* formed in the opposite lower stacking surface (not shown). The corner forming elements 80 and 82 each have cylindrical openings 42" therethrough spaced along their longitudinal axes in similar spaced relation to the openings 42 in the full wall forming elements 28 so as to facilitate axial alignment when the full and half corner forming elements are positioned in stacked relation with each other and with associated ends of the full wall forming elements 28. Pairs of the aligned openings 42" receive retaining pegs 54 or 58 therein for fixedly retaining the corner elements in assembled relation. The legs of the half corner forming elements 82 are approximately one-half the length of the corresponding legs of the full corner forming elements 80.

The corner forming elements 80 and 82 have furring clips 66" formed on their inner side surfaces, the furring clips 66" being spaced for vertical alignment with furring clips on the underlying and overlying corner forming and wall forming elements when in stacked relation therewith. Additionally, each of the corner forming elements 80 and 82 preferably has a right-angle spacer 84 formed integrally therewith at its interior corner to receive and support the mating corner edges of sheets of sheetrock or interior wall board as may be employed to form interior surfaces in the building 10.

Having described the wall forming elements 28 and 76 and the corner forming elements 80 and 82, it can be seen that the wall and corner forming elements may be assembled in stacked relation to form substantially any desired size wall with the various elements being interlocked in weathertight relation through the retaining pegs 54 or 58. As aforedescribed, the abutting end surfaces of the various wall and corner forming elements define cylindrical openings therethrough which receive retaining pegs to prevent leakage of air therethrough, thus substantially improving the insulation properties of the assembled wall and corner forming elements.

Another important feature of the present invention is that the various wall forming and corner forming elements can be made of substantially any material which provides suitable strength and resistance to the environmental conditions at the site at which the building 10 will be constructed. For example, the various elements may be formed from low cost reclaimed organic materials normally considered to be substantially useless. One such material that has been found to exhibit the desired structural characteristics and which may be readily formed into the various wall and corner forming elements of the building 10, is a material identified as "envirite". "Envirite" derives from processing of animal dung such as from cattle and the like. When combined with discarded glass and cooked under pressure in special ovens, the glass foams and the waste material disappears leaving an odorless and fireproof material having a weight equal to approximately 1/20th the weight of clay brick and with substantially equal durability. This material lends itself to being formed into the desired wall and corner forming elements 28, 76, 80 and 82, and may be sawed, drilled, painted and glued.

Alternatively, the various wall and corner forming elements of the building 10 may be made from materials indigenous to a particular construction site, such as various clays and the like which can be formed into the desired structural configurations and which have sufficient structural integrity. Other materials from which the various elements of the building structure 10 may be made include fly ash, certain treated organic garbage and waste materials, and the residual products of reclaimed sludge.

Figure 7:
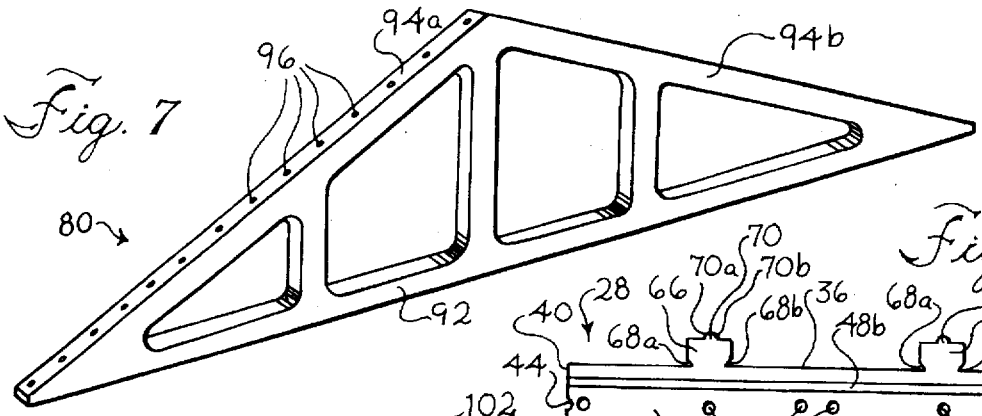
FIG. 7 is a perspective view of a typical roof joist employed in making the roof of the building structure of FIG. 1.

FIG. 7 illustrates a roof truss, indicated generally at 90, for use in constructing the roof portion 24 of the building 10. The roof truss 90 has a generally triangular configuration and includes a base portion 92 which defines a horizontal ceiling joist when the roof truss is supported on the side walls of the building. The truss 90 has upwardly inclined support surfaces 94*a*, 94*b* each of which has a plurality of equidistantly spaced cylindrical openings 96 formed therein with their axes normal to the respective surfaces 94*a, b*. The openings 96 are sized to snugly receive retaining pegs 54 or 58 therein. In constructing the roof portion 24 of building 10, a plurality of the roof trusses 90 are supported in upstanding relation on the upper edges of the side walls in substantially parallel spaced relation, it being conventional to space the trusses and associated ceiling joists on approximately 16 or 24 inch centers.

Figure 8:
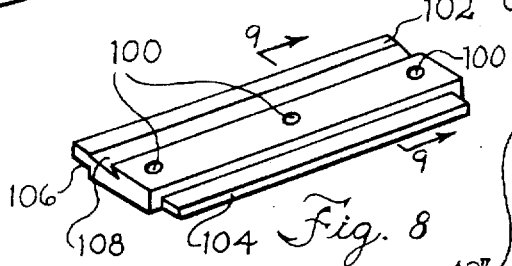
FIG. 8 is a perspective view of a roof board also employed in forming the roof of the building of FIG. 1.
Figure 9:
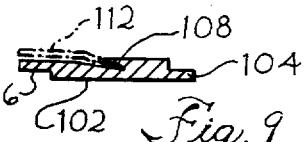
FIG. 9 is a transverse sectional view of the roof board of FIG. 8, taken substantially along thhe line 9—9 of FIG. 8.

The openings 96 in the upper inclined surfaces 94*a, b* of the roof trusses 90 are spaced to facilitate axial alignment with openings 100 formed through roof boards one of which is indicated at 102 in FIGS. 8 and 9. The roof boards 102 are mounted on the trusses 90 transverse to the planes of the trusses and preferably have at least one outwardly extending longitudinal tenon 104 formed integral along one edge thereof to provide a mortise and tenon type connection to an adjacent roof board when assembled on the roof trusses. To this end, each of the roof boards 102 has a longitudinally extending mortise recess or open slot 106 formed in the edge thereof opposite the tenon 104 to accommodate interfitting relation of the roof boards 102. Each of the roof boards 102 also preferably has a longitudinally extending slot 108 formed in its upper surface which is tapered toward its inward end so as to receive a longitudinal edge of a shingle or other roof covering, a portion of which is indicated in phantom at 112 in FIG. 9. Each of the shingles or roof covering sheets 112 is inserted into an associated tapered groove 108 so as to be frictionally retained therein, and has sufficient transverse width to overlap the next below shingle 112 in a conventional manner.

The trusses 90 and roof boards 102 may be made of a reclaimed material similar to the described envirite or other suitable material which lends itself to relatively low cost construction. When assembling the trusses 90 onto the upper edges of the side walls in the course of assembling the building 10, the building trusses adjacent the front and rear upstanding walls are preferably spaced slightly back from the planes of the walls to allow the continued upward stacking of wall forming elements 28 and their combination with generally trapezoidal shaped and triangular shaped forming elements 116 and 118 each of which has an upwardly angled surface having a pitch substantially equal to the pitch of the surfaces 94*a, b* on the roof trusses 90 so as to provide a snug fit with the overlying roof boards 102 which extend outwardly beyond the front and rear walls sufficiently to provide suitable overhang.

Figure 12:
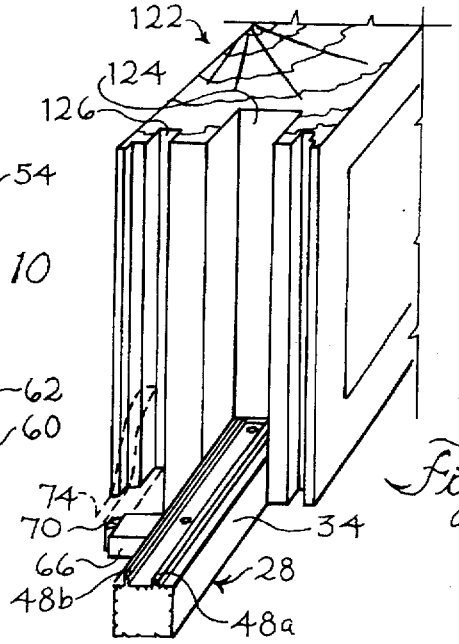
FIG. 12 is a fragmentary perspective view illustrating a typical window frame or door jamb for framing out a window or door opening.

As noted, the full and half wall forming elements 28 and 76 are configured so as to provide vertical planar edges for door and window openings in the building 10. FIG. 12 illustrates a portion of a casing 122 which may be employed in forming the door jamb 18 and the window frames 20' and 22'. The casing 122, which may be made of wood or a reclaimed material such as used in making the wall and corner forming elements, has a longitudinally extending groove or slot 124 adapted to be received over the edges of the wall forming elements defining the window or door opening, one such wall forming element 28 being shown in FIG. 12. The casing 122 has a second smaller longitudinally extending groove or slot 126 adapted to be received over an adjacent edge of the interior sheetrock 74. In this manner, lengths of the casing 122 may be cut to size and mitered at their corners for inserting into the window and door openings for cooperation with the adjacent edges of the wall forming elements and interior sheetrock to define suitable window frames and door jambs for installation of windows and doors in a conventional manner.

Thus, in accordance with the present invention, a system for constructing a building is provided wherein the various elements may be readily assembled with a mallet or the like without need for nails or additional tools as are required in conventional building construction techniques. Merely positioning the wall and corner forming elements in stacked relation with their respective ribs and grooves in interfitting relation and positioning the roof trusses and roof boards in position with the peg receiving openings axially aligned facilitates connection of the various elements in fixed relation by retaining pegs 54 or 58 to provide a weather-tight structurally sound building structure. The building 10 is particularly adapted for economically disadvantaged areas because of its ease of assembly and relatively low manufacturing cost.

A feature of the building 10 is that the outer surfaces of the wall and corner forming elements may be textured or contoured during their manufacture to provide a desired external appearance such as a simulated brick or stone appearance. Another feature of the building 10 lies in the fact that the various components or elements may be made from low cost reclaimed materials or materials indigenous to the intended site of construction.

Where desired, the furring clips 66 and 66' may be broken from the side wall and corner forming elements by striking them with a block or mallet. When used, however, the furring clips provide means for readily securing an interior surface such as sheetrock to the upstanding walls.

The various elements of the building 10 may be made on a substantially reduced scale so as to provide a training kit for perspective builders of structures employing the technique of the present invention. Preferably, the various elements such as the full wall forming elements 28, the half wall forming elements 76 and the corner forming elements 80 and 82 are color coded or otherwise identified to facilitate proper selection in combining of the elements in making a particular building structure. Although FIG. 1 shows the exterior surfaces of wall forming elements as being color coded, as represented by different shading on the various elements, the color coding is preferably provided on a surface of the respective elements which will not be exposed either externally or internally upon completion of the building construction.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. The system for constructing a building comprising, a plurality of unitary wall forming elements each of which has generally parallel stacking surfaces facilitating stacking of a plurality of said wall forming elements one on the other in horizontally offset relation, said wall forming elements having longitudinally extending slot and key projections thereon for interfitting relation so as to provide a substantially weather-tight fit between the stacked elements, a plurality of corner forming elements having a pair of integral legs defining a predetermined angle therebetween, the corner forming elements including longitudinally extending slot and key projections formed thereon for interfitting relation with similar corner forming elements when in stacked relation therewith, each of said wall forming and corner forming elements further having a plurality of transverse openings therethrough at least one of which is positioned for axial alignment with an opening in at least one other wall forming and corner forming element when in stacked relation therewith, a plurality of retaining pegs for being snugly inserted into at least two axially aligned openings in a pair of stacked elements so as to prevent relative longitudinal movement therebetween, whereby stacking a plurality of said wall forming elements in interconnected relation define the walls of the building.

2. The system for constructing a building comprising, a plurality of unitary wall forming elements each of which has generally parallel stacking surfaces facilitating stacking of a plurality of said wall forming elements one on the other in horizontally offset relation, said wall forming elements having longitudinally extending slot and key projections thereon for interfitting relation so as to provide a substantially weather-tight fit between the stacked elements, each of said wall forming elements further having a plurality of transverse openings therethrough at least one of which is positioned for axial alignment with an opening in at least one other wall forming element when in stacked relation therewith, and a plurality of retaining pegs for being snugly inserted into at least two axially aligned openings in a pair of stacked elements so as to prevent relative longitudinal movement therebetween, whereby stacking a plurality of said wall forming elements in interconnected relation define the walls of the building, and a plurality of roof trusses having sufficient length to extend between two generally parallel upstanding walls in supporting relation therewith, said roof trusses each having upper support surfaces having spaced openings therein, and a plurality of roof boards each having a plurality of openings therethrough, said roof boards supported by said roof trusses in generally oblique or transverse relation thereto with said openings in said roof boards axially aligned with said openings in said roof trusses, each pair of said aligned openings receive one of said retaining pegs snugly therein to retain said roof boards on said roof trusses.

3. The system as defined in claim 2 wherein said roof boards have mortise and tenon means thereon facilitating interfitting edge connection between adjacent roof boards when placed on said trusses and secured thereto through said retaining pegs.

4. The system as defined in claim 2 wherein said unitary wall forming elements comprise a first set of full wall forming elements each of which has predetermined longitudinal length, and including a second set of half wall forming elements each of which has a longitudinal length substantially equal to approximately one-half the longitudinal length of said full wall forming elements, said first and second sets of walls forming elements stacked one on the other in a manner to terminate common end surfaces thereof in a generally vertical plane.

5. The system as defined in claim 4 further including first and second sets of corner forming elements each of which has substantially identical transverse configuration to said wall forming elements, said corner forming elements facilitating interfitting substantially weather-tight connection therebetween when in stacked relation, said first and second corner elements being stackable with said wall forming elements so as to form substantially right angle corner connections between walls of a building.

6. The system as defined in claim 2 wherein said wall forming elements, said corner forming elements, said roof trusses and said roof boards are made of reclaimed material.

7. The system as defined in claim 6 wherein said wall and corner forming elements have external surfaces formed thereon presenting a desired simulated external appearance.

8. The system as defined in claim 1 wherein said wall forming elements each have opposite end surfaces for abutting relation with end surfaces of adjacent wall forming elements when disposed in longitudinal alignment therewith, each of said end surfaces having a semi-cylindrical recess formed therein for complementary relation with a similar recess in an abutting end surface to define a cylindrical hole to receive one of said retaining pegs snugly therethrough to provide a substantially weather-tight end connection between said abutting end surfaces.

9. The system for constructing a building comprising, a plurality of unitary wall forming elements each of which has generally parallel stacking surfaces facilitating stacking of a plurality of said wall forming elements one on the other in horizontally offset relation, said wall forming elements having longitudinally extending slot and key projections thereon for interfitting relation so as to provide a substantially weather-tight fit between the stacked elements, each of said wall forming elements further having a plurality of transverse openings therethrough at least one of which is positioned for axial alignment with an opening in at least one other wall forming element when in stacked relation therewith, and a plurality of retaining pegs for being snugly inserted into at least two axially aligned openings in a pair of stacked elements so as to prevent relative longitudinal movement therebetween, whereby stacking a plurality of said wall forming elements in interconnected relation define the walls of the building, wherein said wall forming elements have furring clips formed integral therewith and projecting transversely of said elements, said furring clips being positioned so as to be in substantially vertical alignment with similar clips when a plurality of said wall forming elements are disposed in stacked and horizontally staggered interfitting relation.

10. The system as defined in claim 9 wherein said furring clips are spaced longitudinally along each of said wall forming elements so that when said wall forming elements are in stacked interfitting relation, said furring clips establish vertical columns of furring strips spaced a predetermined distance therebetween to facilitate support of interior sheet material therebetween.

11. The system as defined in claim 10 wherein each of said furring clips has a roughened surface thereon adapted for cooperation with an edge surface of said interior sheet material to frictionally retain said sheet material in upstanding relation between adjacent vertical furring clip columns.

12. The system as defined in claim 11 wherein said furring clips are breakable from the remaining portions of their respective wall forming elements.

13. The system for constructing a building comprising, a plurality of unitary wall forming elements each of which has generally parallel stacking surfaces facilitating stacking of a plurality of said wall forming elements one on the other in horizontally offset relation, said wall forming elements having longitudinally extending slot and key projections thereon for interfitting relation so as to provide a substantially weather-tight fit between the stacked elements, each of said wall forming elements further having a plurality of transverse openings therethrough at least one of which is positioned for axial alignment with an opening in at least one other wall forming element when in stacked relation therewith, and a plurality of retaining pegs for being snugly inverted into at least two axially aligned openings in a pair of stacked elements so as to prevent relative longitudinal movement therebetween, whereby stacking a plurality of said wall forming elements in interconnected relation define the walls of the building, wherein said retaining pegs have external threads thereon and each includes a transverse slot formed in an axial end surface thereof to facilitate entry of a tool for rotating said pegs within axially aligned openings in said stacked wall forming elements.

14. A system for constructing a building having upstanding walls and a roof, comprising, a plurality of substantially identically shaped first unitary wall forming elements each of which defines parallel upper and lower stacking surfaces, inner and outer edge surfaces, and end surfaces normal to the planes of said upper and lower stacking surfaces, each wall forming element having substantially greater longitudinal length than transverse width and having greater transverse width than thickness, each of said wall forming elements further including at least one longitudinally extending slot in one of said upper and lower stacking surfaces and having an outwardly extending key formed longitudinally thereof on the other of said upper and lower stacking surfaces, the slots and keys of said wall forming elements being located to facilitate substantially weather-tight interfitting relation therebetween when said wall forming elements are stacked one on the other whereby relative movement between said stacked elements transversely thereof is prevented, each of said wall forming elements having a plurality of longitudinally spaced openings formed transversely therethrough so as to intersect said upper and lower stacking surfaces, said openings being adapted for axial alignment with openings in next adjacent wall forming elements when in stacked relation therewith, a plurality of substantially identically shaped second wall forming elements each of which has substantially identical configuration to said first wall forming elements except that its longitudinal length is a predetermined fraction of the length of said first wall forming elements, a plurality of substantially identically shaped full corner forming elements each of which has a transverse cross sectional configuration similar to said wall forming elements except for defining a predetermined corner angle intermediate the ends thereof, said corner elements being adapted for stacking relation with one another and with said wall forming elements, each of said wall forming and corner forming elements having a generally semi-cylindrical recess formed in each of its opposite end surfaces for cooperating relation with similar recesses in the ends of adjacent wall forming and corner forming elements to facilitate entry of retaining pegs therein to prevent air passage between the adjacent ends of said stacked corner and wall forming elements, a plurality of retaining pegs each of which is adapted to be inserted through at least two axially aligned openings in said wall forming and corner forming elements when in stacked relation, a plurality of roof trusses adapted to be supported in upstanding relation on the upper edges of walls formed from said wall and corner forming elements, said trusses defining upwardly directed surfaces having longitudinally spaced openings therein, and a plurality of roof boards adapted to be supported on said upwardly directed surfaces of said trusses and having openings formed therein for axial alignment with said openings in said upwardly directed surfaces so as to facilitate entry of retaining pegs therein for maintaining said roof boards in supported relation on said trusses.

15. The system as defined in claim 14 wherein each of said roof boards has groove means therein for frictionally attaching a shingle thereto.

16. A wall forming element for use in forming a wall of a building structure, said wall forming element comprising an elongated body defining upper and lower substantially parallel stacking surfaces, inner and outer edge surface and opposite end surfaces, said wall forming element further defining at least one longitudinally extending rib extending outwardly from one of said upper and lower stacking surfaces and defining at least one longitudinally extending slot in the other of said stacking surfaces, said rib and slot being positioned to facilitate stacking of a plurality of said elements with their said ribs and slots in interfitting relation, said wall forming element further having a plurality of openings therethrough having predetermined positions to facilitate axial alignment with similar openings in other of said wall forming elements when in stacked relation therewith, wherein said wall forming element has at least one furring clip formed integral therewith and projecting transversely of said element, said furring clip being positioned so as to be in substantially vertical alignment with similar clips when a plurality of said elements are disposed in stacked interfitting relation.

17. The wall forming element of claim 16 wherein each of said opposite end surfaces has a semi-cylindrical recess therein positioned to cooperate with a similar recess in the end surface of an adjacent identical longitudinally aligned wall forming element to define an opening therebetween adapted to receive a peg therein to form a substantially weather-tight connection between said adjacent end surfaces.

18. The wall forming element as defined in claim 16 wherein said elongated body has a plurality of openings therethrough intersecting said upper and lower stacking surfaces, said openings being positioned so that at least some of said openings are axially aligned with the openings in an identically shaped second wall forming element when positioned in stacked relation to overlie or underlie one-half the length of said wall forming element.

* * * * *